US006962609B2

(12) United States Patent
Rogers et al.

(10) Patent No.: US 6,962,609 B2
(45) Date of Patent: Nov. 8, 2005

(54) MULTI-COLORED FABRICS MADE FROM A SINGLE DYE FORMULA, AND METHODS OF MAKING SAME

(75) Inventors: Jim Rogers, Chesnee, SC (US); Michael Meadows, Lyman, SC (US)

(73) Assignee: Milliken & Company, Spartanburg, SC (US)

( * ) Notice: Subject to any disclaimer, the term of this patent is extended or adjusted under 35 U.S.C. 154(b) by 165 days.

(21) Appl. No.: 10/686,377

(22) Filed: Oct. 15, 2003

(65) Prior Publication Data

US 2005/0081314 A1 Apr. 21, 2005

(51) Int. Cl.[7] ..... D06P 5/00
(52) U.S. Cl. ..... 8/400; 4/481; 4/529; 4/638
(58) Field of Search ..... 8/400, 481, 529, 8/638

(56) References Cited

U.S. PATENT DOCUMENTS

| | | | | |
|---|---|---|---|---|
| 4,446,690 A | | 5/1984 | Warner | |
| 4,446,691 A | | 5/1984 | Warner | |
| 4,449,354 A | | 5/1984 | Moore et al. | |
| 4,449,355 A | | 5/1984 | Moore et al. | |
| 4,449,356 A | | 5/1984 | Warner | |
| 4,454,710 A | | 6/1984 | Warner et al. | |
| 4,457,129 A | | 7/1984 | Schroder et al. | |
| 4,462,557 A | | 7/1984 | Warner | |
| 4,499,637 A | | 2/1985 | Greenway | |
| 4,532,760 A | | 8/1985 | Johnson | |
| 4,670,317 A | | 6/1987 | Greenway | |
| 5,113,708 A | | 5/1992 | Bode et al. | |
| 5,688,288 A | * | 11/1997 | Akatani et al. | 8/639 |
| 5,762,652 A | * | 6/1998 | Reddig et al. | 8/638 |
| 5,916,461 A | | 6/1999 | Costin et al. | |
| 6,039,767 A | * | 3/2000 | Boyes et al. | 8/400 |
| 6,252,196 B1 | | 6/2001 | Costin et al. | |
| 2002/0124323 A1 | | 9/2002 | Cliver et al. | |

FOREIGN PATENT DOCUMENTS

| | | |
|---|---|---|
| EP | 0 121 290 | 10/1984 |

OTHER PUBLICATIONS

*Precise Color Communication: Color Control from Perception to Instrumentation*, published by Minolta Co., Ltd., 1998, pp. 22–23.
*A Guide to Understanding Color Communication*, published by X–Rite, Incorporated, 2000, pp. 11–12.
*The Theory of Coloration of Textiles*, Second Edition, Society of Dyers & Colourists on behalf of the Dyer's Company Publications Trust, 1989, pp. 184–189.

* cited by examiner

*Primary Examiner*—Margaret Einsmann
(74) *Attorney, Agent, or Firm*—Terry T. Moyer; Sara M. Current

(57) ABSTRACT

A process for making multi-colored fabrics from a single dye formula is described. The process involves providing a substrate including synthetic fibers, with the substrate having defined regions where the synthetic fibers have differing levels of fiber orientation, and dyeing the substrate with a dye bath containing at least one dye from at least two of the categories of a) high contrast dyes, 2) medium contrast dyes and c) low contrast dyes, to thereby produce a multi-colored substrate from a single dye formula. The substrates are characterized by having a base of a first color and patterned regions of a different color, with the regions of different colors corresponding to regions of different levels of fiber orientation.

13 Claims, 1 Drawing Sheet

MULTI-COLORED FABRICS MADE FROM A SINGLE DYE FORMULA, AND METHODS OF MAKING SAME

BACKGROUND OF THE INVENTION

There are a number of conventional ways to make multi-colored fabrics. Some of these ways utilize solution dyed or package dyed yarns (where the fiber is dyed during the polymerization process, or individually in yarn form, respectively.) The dyed yarns can then be selectively positioned during the fabric formation process (e.g. knitting or weaving process), to produce a patterned fabric. Examples of this type of construction are jacquard woven and jacquard knit fabrics.

Another way to create multi-colored products is to blend multiple types of fibers together before dyeing. The fibers are then exposed to one or more classes of dyes that affect only one of the fiber constituents, such that one fiber component is dyed a different color from the other. Such examples include common blends such as polyester/cotton and polyester/nylon fabrics.

Another common technique used is fabric printing. A fabric can be printed to apply more than one color to it, or it can be dyed an initial base shade, and then overprinted.

In each of these cases, multiple processes and raw materials must be used. In package and solution dyed yarns, the yarn is processed and then made into fabric. Because this can necessitate a large inventory of small quantities of different colors of yarns and because of the number of steps involved in the process, it is traditionally done at a much higher cost than dyeing a solid fabric. For blends, the dye mix must consist of multiple sets of dyes for each yarn and compatible chemistry so that the fibers may be dyed together in the same bath. When printing, another step is added after dyeing for the overprint pattern, and in the case of screen printing, a different screen must be manufactured for each design required. All of these processes add increased cost, labor, and time to the creation of the final product.

An additional method for achieving multi-colored fabrics is described in commonly-assigned U.S. Published Patent Application Serial No. 20020124323A1 to Cliver et al. published Sep. 12, 2002, the disclosure of which is incorporated herein by reference. This application describes a process for providing a patterned resist chemistry across the fabric surface and then dyeing the fabric. The regions corresponding to the locations of the resist chemistry do not become saturated with the dye, and thus enable the achievement of multi-toned fabrics through a single dye formula. To achieve multi-colored fabrics, a dye can be included in the resist chemistry, so that the regions where it is applied are dyed a different color.

Another method that has been used to create tone-on-tone variations in fabrics is described in commonly-assigned U.S. Pat. Nos. 4,499,637 and 4,670,317 to Greenway, the disclosures of which are incorporated herein by reference. In this method, a fabric, either before or after dyeing, is contacted in a pattern with heated pressurized streams of fluid, to thermally modify (i.e. change the orientation of) fibers in certain regions. When the fabric is subsequently dyed, two-tone dye effects can be achieved. While providing many advantages, to date this method has been limited to the production of tone-on-tone effects as opposed to the production of fabrics of two or more different colors through a single dye formula.

SUMMARY

This invention describes a novel approach to creating a fabric with multiple colors utilizing a single dye formula. The process is accomplished by providing a synthetic fiber-containing substrate having regions of greater and lesser fiber orientation and treating the substrate with dyestuffs selected based on their ability to exhaust differentially to those areas of different fiber orientation. Specifically, the substrate is dyed with a single dye formula containing at least one dye from at least two of the categories of a) high contrast dyes, b) medium contrast dyes and c) low contrast dyes. Because at least one of the dyes utilized will-tend to preferentially dye the regions of lesser fiber orientation, the resulting substrates have at least two distinct colors. (For purposes of this application, where the term "single dye formula" is used, it is intended to mean a combination (two or more) of dyes from a single dye class (e.g. all disperse dyes, all acid dyes, etc.))

DETAILED DESCRIPTION

Figure 1:
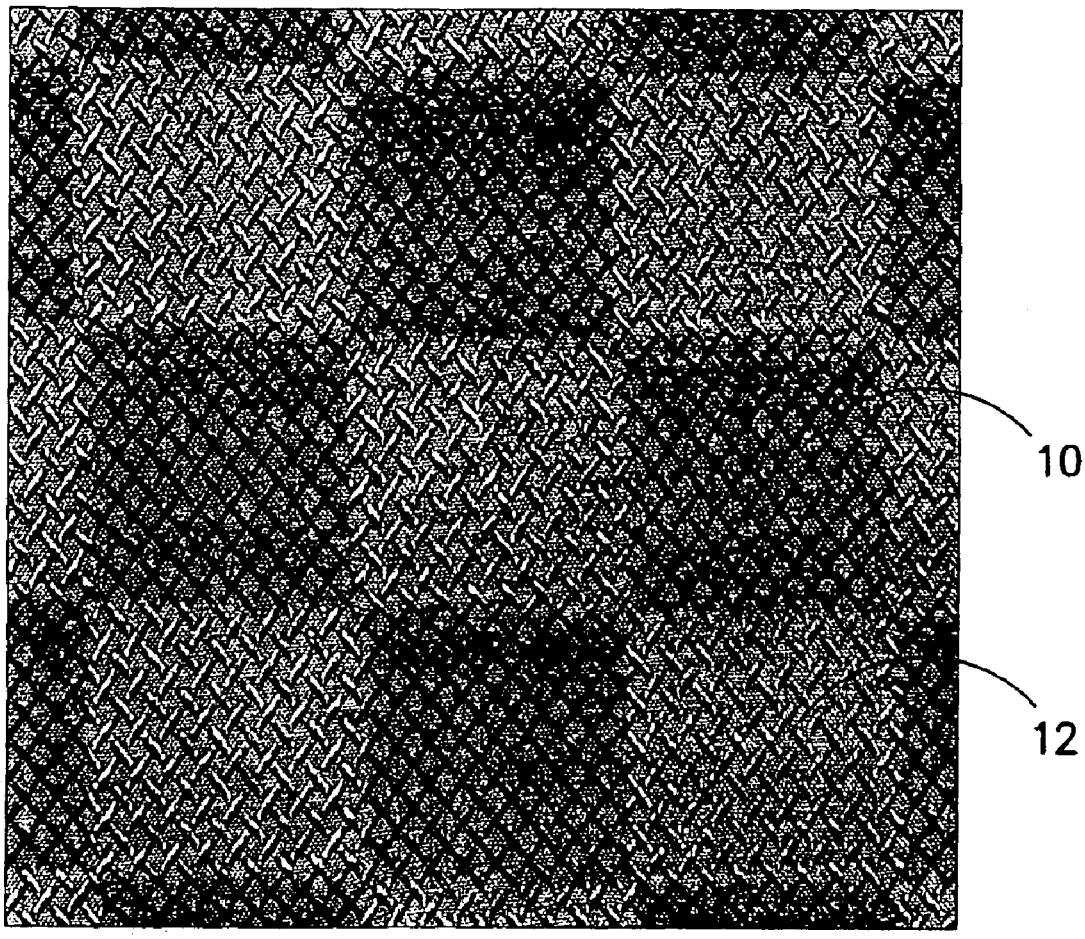
FIG. 1 is a photograph of the fabric made according to Example A.

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

It was surprisingly found by the inventors that by selecting a textile substrate having defined regions that had different levels of fiber orientation and treating the substrate with a single dye formula using at least one dye from at least two distinct categories, at least one of the dyes would tend to preferentially dye the region of lesser fiber orientation, while the other dye affected both the regions of greater and lesser fiber orientation. The result was a fabric with two distinct colors, as opposed to the tone-on-tone looks achieved by other single dye processes.

The substrate can be in the form of a yarn or fabric containing a synthetic fiber component. Where the substrate is a fabric, it can be manufactured in any manner, such as by weaving, knitting or a nonwoven manufacturing process. Furthermore, the fabric can be in the form of a flat fabric or a three-dimensional fabric, such as a pile fabric. Similarly, where the substrate is in the form of a yarn, it can be of any variety such as a spun or filament or combination yarn, provided it includes synthetic fibers and has regions of greater and lesser fiber orientation.

The synthetic fibers can be of any variety, provided they are capable of being provided at different levels of fiber orientation. For example, examples of synthetic fibers that are useful in the invention include, but are not limited to polyester, nylon, aramids, and the like. The substrates can be made entirely or substantially entirely of synthetic fibers, from blends of synthetic fibers, or blends of synthetic and non-synthetic fibers.

The substrate is manufactured or treated so that it has first regions where the fiber component has a first level of fiber orientation, and a second region where the fiber component has a second level of fiber orientation that is less than the first level. (As will be appreciated by those of ordinary skill in the art, the level of fiber orientation can be affected by things such as thermal modification or draw ratio. This can be achieved in a variety of ways. For one, a yarn can be produced in a manner like that described in commonly-assigned U.S. Pat. No. 4,449,355 to Moore et al., U.S. Pat. No. 4,449,356 to Warner, U.S. Pat. No. 4,454,710 to Warner et al., and 4,532,760 to Johnson, the disclosures of which are incorporated herein by reference. These patents describe processes which utilize intermittent changes in draw ratio of a yarn to achieve a yarn which has alternating regions of greater and lesser fiber orientation along the length of the yarn. In this embodiment, the yarns can be dyed in accordance with the invention prior to or subsequent to fabric formation. The resulting fabrics have a unique pattern of multi-color striations.

Alternatively, a fabric containing synthetic fibers can be treated, such as by a thermal treatment process, to achieve regions of greater and lesser fiber orientation across the dimension of the fabric. For example, the fluid treatment process described in U.S. Pat. Nos. 4,499,637 and 4,670,317 to Greenway (incorporated supra) can be utilized to achieve a predetermined pattern of regions having greater and lesser levels of fiber orientation. This method is particularly desirable when manufacturing pile fabrics according to the process of the invention, because it can be performed in a manner that deflects or removes portions of selected pile yarns, to create a particularly dramatic effect in combination with the multi-colored appearance.

As a further alternative, a textile substrate could be modified by methods such as the laser modification methods described in U.S. Pat. No. 5,916,461 to Costin et al, issued Jun. 29, 1999, and U.S. Pat. No. 6,252,196 to Costin et al., published Jun. 26, 2001, or by using an engraved calender roll at a temperature above the $T_m$ for the synthetic fiber material. (For example, processing so that the substrate sees a temperature above about 440° F. for polyester and 419° F. for nylon would be expected to achieve desirable results.)

Where the fiber orientation modification is performed to a fabric, it can be performed such that fiber modification occurs primarily on one fabric surface (so as to produce a one-sided patterning) or it can affect both fabric surfaces, so as to create a two-sided pattern. For example, the fluid treatment and laser processes described above have been found to be capable of producing one-sided patterns where so desired.

The substrate is then treated by a single dye formula, which serves to produce a multi-colored fabric. The dyeing can be performed in any conventional manner including, but not limited to jet dyeing, thermosol dyeing, foam application, beam dyeing, jig dyeing, and the like. The dye mixture can also include typical auxiliaries such as sequestrants, acetic acid, leveling agents, etc., and may include additional supplemental chemistries such as soil release agents, hydrophilizing agents, flame retardants, antimicrobial agents, UV inhibitors, softeners, etc. However, it has been found that the dyes tended to attach preferentially to a greater extent when the leveling agent is minimized or eliminated. The dyeing can be performed according to conventional parameters or at slightly lower temperatures (e.g. 100% polyester fabrics will typically be dyed at a temperature between about 266° F. and 280° F., and 100% nylon fabrics are typically dyed at a temperature between about 180 and 230° F.). However, it has been found that with polyester, greater dye stratification is typically achieved at the lower end or below the typical recommended ranges (e.g. 250° F. for polyester), while with nylon, a dye temperature of about 220° F. yielded optimal results.

This unique dye process involves selecting at least one dye from each of at least two dye categories (as further described below), and treating the fabric with this dye combination. Specifically, the dye formula should include at least one dye from at least two categories of a) high contrast dyes, b) medium contrast dyes and c) low contrast dyes. To define these categories, the inventors tested a large number of dyes according to the following method.

A dobby weave fabric was made using 100% disperse polyester having 1/150/34 56T polyester (available from E.I. duPont de Nemours of Wilmington, Del.) in the warp and filling with a construction of 74 ends per inch by 60 picks per inch. The fabric had a greige weight of 2.85 oz/sq yard. The fabric was desized and dried, then treated using a hot fluid treatment of the variety described in commonly-assigned U.S. Pat. Nos. 4,499,637 and 4,670,317 to Greenway at 680° F. and 3.6 psi at a treatment speed of 4 yards per minute, to produce 1.5 inch squares in a checkerboard pattern. As will be appreciated by those of ordinary skill in the art, it was understood by the inventors that the thermal treatment of the patterned areas of the fabric served to change the orientation of the fiber structure in those areas. Without being bound by any theory, it is the inventors' belief that this fluid treatment process lowers the fiber orientation in the patterned regions.

For purposes of dye analysis, a large number of disperse dyestuffs were obtained. Each dyestuff was weighed out in increments of 2.0% (o.w.f.) Each amount of dyestuff was put into a separate sample dye vessel along with 0.9% acetic acid, 0.1% sequestering agent and a 20 gram swatch of the 100% polyester fabric described above. Each sample was dyed at 250° F. for 30 minutes and then cooled, rinsed and dried. The fabric swatches were then evaluated visually and classified as having low contrast, medium contrast or high contrast by color grouping (red, yellow, blue, etc.) Each sample was then read on a spectrophotometer in two locations. The standard location (Light portion) was chosen from a base area on the fabric. As used herein, the term "base" or "standard" will refer to the areas of higher fiber orientation while the term "pattern" or "patterned" will refer to the area of lesser orientation. A patterned region of the fabric was then measured as the experimental region (Dark Region). Each measurement was recorded in absolute values of: L*, a*, and b*. The samples and their respective results were recorded. The dyes were also visually rated for the amount of contrast between the base and patterned regions of the dyed samples. By the term "contrast", it is meant that the dye had a marked tendency to dye the regions of lesser fiber orientation significantly more than the regions of greater fiber orientation. It was found that for classifying individual dyes by contrast, the determining value is the absolute Delta L*, where as L* defines the lightness value. (As will be readily appreciated by those of ordinary skill in the art, the Delta L* ("DL*") is the light/dark difference of the patterned area minus the standard. It is obtained by measurements made on any commercially available spectrophotometer or calorimeter.) Categories are: low contrast=up to Delta L* of 2.0, medium contrast=DL* of greater than 2.0 to 4.4, and high contrast=DL* greater than 4.4. While DL* comparison was generally reliable, the readings should also desirably be visually confirmed, to account for any aberrations.

Example DL* ratings for several of the dyes tested are listed in the table below.

| DYESTUFF | DELTA L |
|---|---|
| High Contrast Dyes | |
| Dianix Red BLS 100% powder | 4.5 |
| Terasil Yellow BRLF 50% paste | 5.6 |
| Terasil Blue BLF powder | 5.5 |
| Foron Navy SR 100% paste | 6.8 |
| Medium Contrast Dyes | |
| Foron Rubine S2GFL powder | 4.3 |
| Intrasil Bordeaux 3BSK powder | 3.9 |
| Terasil Orange GFA powder | 3.8 |
| Terasil Blue BGE 100% paste | 3.7 |
| Low Contrast Dyes | |
| Dianix Yellow AM-5G powder | 0.7 |
| Dianix Pink AM-REL 100% paste | 1.8 |
| Dianix Yellow S-6G 200% powder | 0.4 |
| Dianix Blue S-BG 200% powder | 2.0 |

Dianix dyes are commercially available from Dystar L.P. of Charlotte, N.C., Terasil dyes are available from Ciba Specialty Chemicals Corporation of High Point, N.C., Foron dyes are available from Clariant Corp. of Charlotte, N.C., and Intrasil dyes are available from Yorkshire Americas, Inc. of Charlotte, N.C.

As noted, for each color, a number of dyes were tested to determine which dyes within that color space were high, medium and low contrast. As will be appreciated by those of ordinary skill in the art, disperse dyes typically classified as azo, anthroquinone or "other." Some generalities were found, namely that azo dyes tended in general to be high or medium contrast, anthroquinone dyes tended in general to be medium contrast, and heterocyclic and other dyes tended in general to be medium to low contrast, though they varied to a greater extent. However, it was found that the generalities did not hold for all colors within a specific dye type, thus confirming the importance of categorizing dyes through individual dyeings and visual classification.

It was then discovered that by engineering the dye formula to include at least one dye from two of the above-described categories, the lower contrast dye would tend to dye the entire fabric relatively more evenly, while the higher contrast dye would tend to preferentially dye the regions of lesser fiber orientation. As a result, a substrate having two distinct colors, as opposed to simple tone-on-tone effects, could be achieved. Although the amount of color difference is described best based on visual appearance, differences in color for were measured as described below. For each sample of color, a spectral reading was taken using a spectrophotometer (commercially available from a variety of sources and manufacturers). The system takes measurements and reports in both L*a*b* and L*C*h* color space. Having these values allowed the inventors to define multi-color variation in numerical form. For example, for each sample collected, two readings were made. The standard was always a portion of the yarn/fabric that had not been patterned to reduce its fiber orientation. The second reading or pattern was also made from the modified region of the yarn/fabric. Thus measuring the difference between the pattern area and the standard, results were displayed on the spectrophotometer as DL*, Da*, Db*, DC*, DH*, $DE^*_{ab}$ (CIELAB). In these values, color can be quantified. Again, L* is the color value with regards to lightness. a* defines the red/green value. b* defines the difference as a blue/yellow value. In the L*a*b* color space, color difference can be expressed as a single numerical value, $DE^*_{ab}$, which indicates the size of the color difference from the standard. $DE^*_{ab}$ is defined by the following equation:

$$DE^*_{ab}=[(DL^*)^2+(Da^*)^2+(Db^*)^2]^{1/2}$$

What the individual number $DE^*_{ab}$ does not explain is in what way the colors are different. If we measure the color difference between the pattern and standard using the L*C*h* color space, we can determine the hue or color difference, DH*, as defined by the following equation:

$$DH=[(DE^*_{ab})^2-(DL^*)^2-(DC^*)^2]^{1/2}$$

In this equation, $DE^*_{ab}$ and DL* are the same as above. The C* value or Chroma defines the saturation of a sample's color and the H* or Hue value indicates at what angle on a 360° a*b* chromacity diagram a color is located. DH* takes into account each sample's color position and allows for a numerical value to represent a hue difference.

For the invention described, the multi-color variation that is derived from this process is defined as having a minimum Delta $E^*_{ab}$ of about 3.0 with a DH* of about 1.5 or greater. If a value is shown to have a $DE^*_{ab}$ of less than 3.0 and/or a DH* less than 1.5, it would generally be considered to be tonal. However, as noted above, a final determination for multi-color vs. tonal is recommended to be made based on visual evaluation.

References for describing tonal and color comparison and characterization include *Precise Color Communication: Color Control from Perception to Instrumentation*, published by Minolta Co., Ltd. 1998, *A Guide to Understanding Color Communication*, published by X-Rite, Incorporated 2000, and *The Theory of Coloration of Textiles*, Second Edition, Society of Dyers and Colourists on behalf of the Dyer's Company Publications Trust, 1989, all of which are incorporated herein by reference.

Manufacture of a fabric according to the invention would be performed as follows. The type of fabric would be determined, and the types of dyes used would be tested and classified as high, medium or low contrast according to the procedure described above. The two colors for the fabric to be produced should be determined. The first step is to establish the base color (by any commercial color formulation software available) using dyes that have medium to low contrast characteristics. The patterned color is then created by substituting lower contrast dye(s) with dye(s) listed as having a higher contrast. In some cases, simply adding a high contrast dye to the base formula is also acceptable in creating the patterned area color.

For example, if the desired base color were a gray color, a typical formula would resemble the following: 0.1% yellow dye, 0.1% red dye, and 0.1% blue dye. If the desired pattern color is blue, then a high contrast blue dyestuff would be substituted or added at 0.1% concentration. The level of contrast of the blue dye should be greater than that of the other dyestuffs making up the remaining formulation. If instead, the second color is desired red instead of blue, the dyestuff in the formulation that should have the highest contrast would be the red component.

EXAMPLE A

A dobby weave fabric made from 100% disperse polyester having 1/150/34 56T polyester available from E.I. duPont de Nemours of Wilmington, Del. in the warp and filling with a construction of 74 ends per inch by 60 picks per inch. The fabric had a greige weight of 2.85 oz/sq yard. The fabric was desized and dried, then treated using a hot fluid treatment of the variety described in commonly-assigned U.S. Pat. Nos. 4,499,637 and 4,670,317 to Greenway at 680° F. and 3.6 psi at a treatment speed of 4 yards per minute, to produce 1.5 inch squares in a checkerboard pattern. The fabric was then dyed in a pressurized jet using conventional auxiliaries (0.1% sequestrant, 0.9% acetic acid) with the following: 0.1% Dianix Pink AM-REL 100% paste, 0.1% Foron Navy SR 100% paste, and 0.1% Dianix Yellow AM-5G powder. All percentages are on weight of fabric "owf". The dye cycle consisted of a ramp rate of 2° F. to 250° F. and hold for 30 minutes, and ramp down at 2–4° F./minute. The fabric was then rinsed and dried and taken up.

As illustrated in FIG. 1, the resulting fabric had a blue checkerboard pattern (shown at 10) on a gray base (shown at 12). The Delta E ("$DE^*_{ab}$") between the pattern and the base was 17.35 and the Delta H ("DH*") between the pattern and the base was 1.67.

EXAMPLE B

The same fluid treatment and dyeing process as described in Example A was performed on a 3.5 oz/sq.yd hydroentangled 100% polyester spunlace non-woven fabric containing 1.3 dpf 2.5 inch long polyester staple fiber. The same multi-color pattern effect was seen on the non-woven. An additional attribute that was discovered was that the thermal modification of the fabric surface prevented pilling without hurting the fabric hand. This attribute was durable through dyeing and through at least 15 commercial laundries. For example, the above-described fabric exhibited a pilling rating of 4.5 after 30 minutes when tested according to ASTM 3512-02 Test Method after 15 washes according to AATCC 130-1995 wash procedure.

In addition to achieving unique multi-colored effects, the process of the invention produces fabrics that have colorfastness levels that are the same as those of the individual dyes used to achieve them (which are typically superior to those achieved by conventional printing processes.) Furthermore, the process produces fabrics that have substantially the same aesthetics (e.g. hand and drape) of their unpatterned solid-dyed equivalents. Also, complete dyeing of the fibers can be achieved, as opposed to the surface-only dyeing achieved by printing.

While the above examples have been specifically directed to polyester-containing fabrics, it is noted that the same process can be followed for nylon fiber-containing fabrics using acid dyes. For other fibers, the same dye classification process would be followed, along with the dye selection process. In the case of nylon, it was found that dye temperatures of about 220° F. should be utilized for optimal results.

Substrates of the invention can be used in virtually any end use application. For example, yarns can be used in the manufacture of fabrics or the like, and fabrics can be used in any end use product where multi-colored fabrics have utility, including but not limited to apparel, home furnishings, upholstery, draperies, automotive products, napery, military products, etc.

In the specification there has been set forth a preferred embodiment of the invention, and although specific terms are employed, they are used in a generic and descriptive sense only and not for purpose of limitation, the scope of the invention being defined in the claims.

We claim:

1. A method of making a multi-color textile substrate using a single dye formula comprising the steps of:

providing a substrate containing synthetic fibers, wherein the substrate has base regions where the synthetic fibers have a first fiber orientation and patterned regions where the synthetic fibers are less oriented than the fibers in the base regions, performing a number of individual dyeings using individual dyes on said fabrics to produce a plurality of dyed fabrics;

categorizing said dyed fabrics according to whether the base regions and patterned regions exhibit high contrast, medium contrast, or low contrast; then dyeing the substrate with a single dye formula containing at least one dye from at least two of the categories of a) high contrast dyes, b) medium contrast dyes, and c) low contrast dyes, to thereby produce a multi-colored fabric.

2. The method according to claim 1, wherein said step of dyeing the substrate comprises exposing substantially the entire substrate to a single dye formula.

3. The method according to claim 1, wherein said substrate is in the form of a yarn or fabric.

4. The method according to claim 1, wherein said patterned regions that are less oriented are produced by thermally modifying those regions.

5. The method according to claim 1, wherein said substrate is a yarn, and said patterned regions are formed by varying the draw ratio when the yarn is processed.

6. The method according to claim 1, wherein the synthetic fiber is polyester and wherein high contrast dyes have a DL* value greater than 4.4, medium contrast dyes have a DL* value of greater than 2.0 to 4.4, and low contrast dyes have a DL* value of up to 2.0 wherein DL* is the light/dark difference of the patterned area minus the standard as obtained by measurements made on a colorimeter or spectrophotometer.

7. A fabric produced according to the method of claim 1.

8. A multi-colored substrate comprising:

a substrate containing synthetic fibers, wherein said substrate comprises base regions where the synthetic fibers have a first fiber orientation and patterned regions where the synthetic fibers are less oriented than the fibers in the base regions, wherein the patterned regions are of a different color from said base regions, wherein the color in the base regions contains the same dyes as the color in the patterned regions, and wherein the patterned regions contain a greater concentration of at least one dye than the base regions and substantially the same concentration of at least one dye as the base regions.

9. A substrate according to claim 8, wherein said substrate is a fabric.

10. A substrate according to claim 9, wherein said fabric is selected from the group consisting of woven fabrics, knit fabrics, and nonwoven fabrics.

11. A substrate according to claim 8, wherein said substrate is yarn.

12. A fabric according to claim 8, wherein said synthetic fibers are selected from the group consisting of polyester, nylon and aramid fibers.

13. A fabric according to claim 8, wherein the Delta $E^*_{ab}$ between said base regions and patterned regions is at least about 3.0 and the DH* between said base regions and patterned regions is at least about 1.5.

* * * * *